US010105970B2

(12) United States Patent
Sakajo

(10) Patent No.: US 10,105,970 B2
(45) Date of Patent: Oct. 23, 2018

(54) PEELING DEVICE AND INK JET PRINTER

(71) Applicant: SEIKO EPSON CORPORATION, Tokyo (JP)

(72) Inventor: Hiroaki Sakajo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/636,252

(22) Filed: Jun. 28, 2017

(65) Prior Publication Data

US 2018/0001674 A1 Jan. 4, 2018

(30) Foreign Application Priority Data

Jun. 30, 2016 (JP) ..... 2016-129814

(51) Int. Cl.
*B41J 11/04* (2006.01)
*B65C 9/00* (2006.01)

(52) U.S. Cl.
CPC ..... *B41J 11/04* (2013.01); *B65C 9/0006* (2013.01); *B65C 2009/0009* (2013.01); *B65C 2009/0012* (2013.01); *B65C 2009/0093* (2013.01); *B65C 2210/0078* (2013.01)

(58) Field of Classification Search
CPC ..... B41J 11/04; B65C 2210/0078; B65C 9/0006; B65C 2009/0009; B65C 2009/0012; B65C 2009/0093
See application file for complete search history.

(56) References Cited

U.S. PATENT DOCUMENTS 5,188,029 A * 2/1993 Sugimoto ..... B65C 9/0006 101/288
5,427,460 A * 6/1995 Kajiya ..... B65C 11/0289 156/541
6,766,844 B1 7/2004 Watkins

FOREIGN PATENT DOCUMENTS

JP 2015-160323 A 9/2015

* cited by examiner

*Primary Examiner* — Henok Legesse
(74) *Attorney, Agent, or Firm* — Foley & Lardner LLP

(57) ABSTRACT

The peeling device has a pressing roller that comes into contact with a label attaching surface (a first surface) of the backing paper and a driving roller that comes into contact with a back surface of the backing paper. The peeling device includes a peeling plate that is provided on the upstream side of an interposing roller pair in a transport direction of the backing paper when the label is peeled off from the backing paper and that bends a transport path of the backing paper. The pressing roller is a split roller including a roller shaft and a plurality of rollers. The peeling device includes support frames that support the pressing roller, and coil springs that come into contact with the roller shaft in an area on the pressing roller between the support frames and that bias the pressing roller toward the driving roller.

17 Claims, 6 Drawing Sheets

PEELING DEVICE AND INK JET PRINTER

BACKGROUND

The present disclosure relates to a peeling device and an ink jet printer.

A method is known in which label paper to which labels have been attached is transported while being bent at an acute angle at a peeling portion to cause the labels to be peeled off from the label paper. In such a method, a mechanism for transporting backing paper is provided on the downstream side of the peeling portion.

To simplify setting of the label paper, it is known that interposing rollers are used as the mechanism for transporting backing paper. With such interposing rollers, a residual adhesive on a surface of the backing paper to which the labels have been attached is adhered to the rollers, and this is thought to be an issue affecting transport accuracy. In response to this, for example, a configuration is known in which an area of the roller coming into contact with the label attaching surface is reduced (see JP-A-2015-160323, for example).

However, in the above-described configuration, the interposing amount of each of the rollers biased in a direction of interposing the backing paper varies depending on a position where each of the rollers is biased, and this may affect the transport accuracy.

When printing is performed with a thermal head method as disclosed in the above-described literature, such a variance in the transport accuracy is unlikely to affect the printing quality, because the label paper is interposed between a head and a platen roller at a section on which the printing is performed. However, when the printing is performed with an ink jet method, an oblique motion in the transport direction on the downstream side is likely to affect the transport accuracy at the printing section, thus causing a problem in which the printing quality may be affected.

SUMMARY

In light of the foregoing, an advantage of some aspects of the disclosure is to provide a peeling device and an ink jet printer that are capable of appropriately applying a biasing force to rollers and reducing a variance in the biasing force applied to each of the rollers to improve the transport accuracy.

According to one embodiment, a peeling device configured to peel off a label attached to a first surface of backing paper. The peeling device includes: an interposing roller pair including a first roller and a second roller, the first roller being configured to come into contact with the first surface, the second roller being configured to come into contact with a surface of the backing paper different from the first surface, the interposing roller pair being configured to interpose and transport the backing paper; a peeling plate provided on an upstream side of the interposing roller pair in a transport direction of the backing paper when the label is peeled off from the backing paper, the peeling plate being configured to bend a transport path of the backing paper, the first roller being a split roller including a shaft and a plurality of rollers through which the shaft is inserted; support portions configured to support the first roller; and a biasing member configured to come into contact with the shaft in an area on the first roller between the support portions, the biasing member being configured to bias the first roller toward the second roller.

According to the embodiment, the biasing member is provided that comes into contact with the shaft in the area between the support portions and that biases the first roller toward the second roller, allowing the biasing member to evenly apply a biasing force to the shaft.

As a result, the rollers of the first roller can be pressed evenly against the second roller, allowing the transport accuracy of the backing paper to be improved.

Further, in a peeling device according to another embodiment, with respect to a center in a width direction intersecting the transport direction of the backing paper, an equal number of the biasing members are disposed individually in a first and second areas on the first roller, the first area occupying one side of the center and the second area occupying the other side of the center.

According to the embodiment, the equal number of biasing members can be disposed on left and right sides with respect to the center, allowing the biasing members to evenly apply the biasing force to the shaft.

Further, in a peeling device according to another embodiment, the biasing members come into contact with the first roller in symmetrical positions with respect to a center in a width direction intersecting the transport direction of the backing paper.

According to the embodiment, the biasing members can be disposed in the symmetrical positions on left and right sides with respect to the center, allowing the biasing members to evenly apply the biasing force to the shaft.

Further, in a peeling device according to another embodiment, a roller unit has the first roller and the biasing members mounted thereon.

According to the embodiment, the roller unit is detachable, allowing the roller unit to be easily replaced as a whole when an adhesive is adhered to, for example, a surface of the first roller. This aspect eliminates the need for maintenance, such as cleaning and replacement, of the first roller, allowing usability to be improved.

Further, in a peeling device according to the another embodiment, an operating portion is operated by an user, the roller unit is detachably provided in a cover configured to revolve, attached and detached according to operation to the operation portion and the operating portion is inoperable with the cover closed.

According to the embodiment, the operating portion is disposed in the position where the operating portion is inoperable with the cover closed, preventing the user from accidentally removing the roller unit while the peeling device is in operation.

Further, in a peeling device according to another embodiment, the roller unit has a rib on a surface thereof facing the transport path of the backing paper.

According to the embodiment, the rib is formed, allowing a contact area between the backing paper on which the adhesive remains and the transport path to be reduced and thus making it possible to prevent the backing paper from adhering to the transport path.

Further, in an another embodiment, an ink jet printer includes: a printhead configured to print on label paper including backing paper and a label attached to a first surface of the backing paper, an interposing roller pair including a first roller and a second roller, the first roller being configured to come into contact with the first surface, the second roller being configured to come into contact with a surface of the backing paper different from the first surface, the interposing roller pair being configured to interpose and transport the backing paper; a peeling plate provided on an upstream side of the interposing roller pair in a transport direction of the backing paper when the label is peeled off from the backing paper, the peeling plate being configured to bend a transport path of the backing paper, the first roller being a split roller including a shaft and a plurality of rollers through which the shaft is inserted; support portions configured to support the first roller; and a biasing member configured to come into contact with the shaft in an area on the first roller between the support portions, the biasing member being configured to bias the first roller toward the second roller.

According to the embodiment, the biasing member is provided that come into contact with the shaft in the area between the support portions and that biases the first roller toward the second roller, allowing the biasing member to evenly apply a biasing force to the shaft.

As a result, the rollers of the first roller can be pressed evenly against the second roller, allowing the transport accuracy of the backing paper to be improved. Thus, the transport accuracy of the label paper can be improved even in a printing section defined by a printing head and a platen, and the printing quality can also be improved.

BRIEF DESCRIPTION OF THE DRAWINGS

Embodiments of the invention are described with reference to the accompanying drawings, wherein like numbers reference like elements.

DESCRIPTION OF EMBODIMENTS

An exemplary embodiment of the invention is described below with reference to the accompanying drawings.

Figure 1:
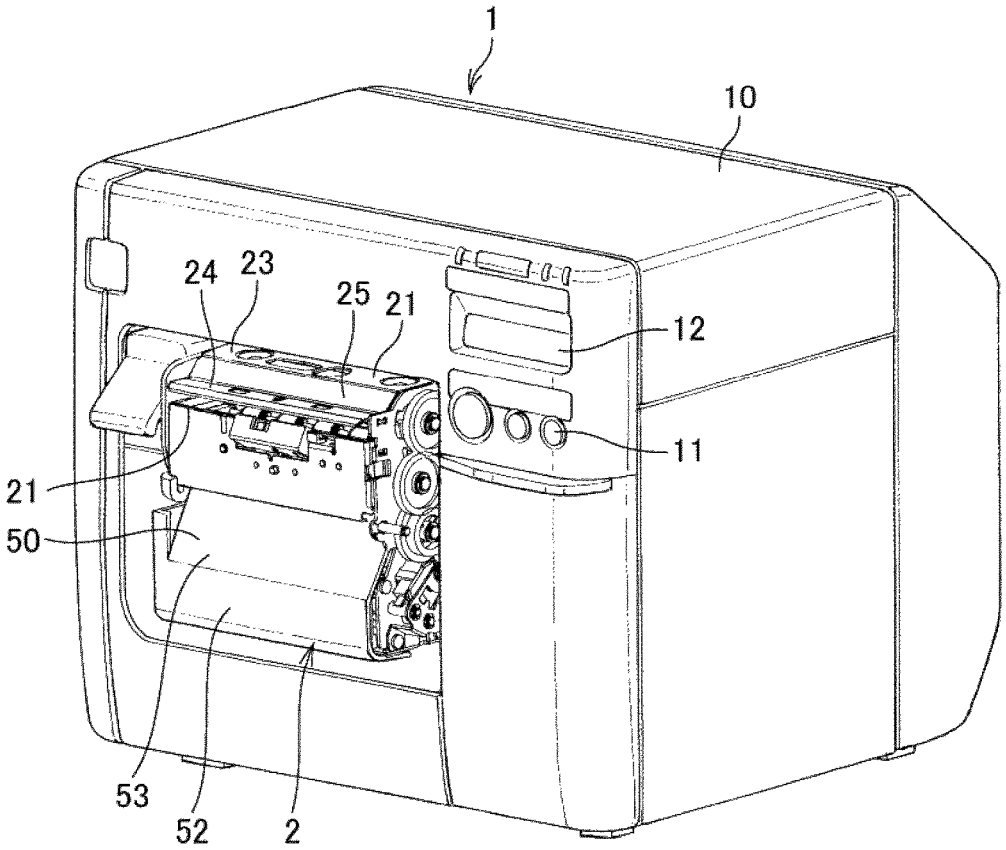
FIG. 1 is a schematic perspective view of an ink jet printer according to an exemplary embodiment of the invention.
Figure 2:
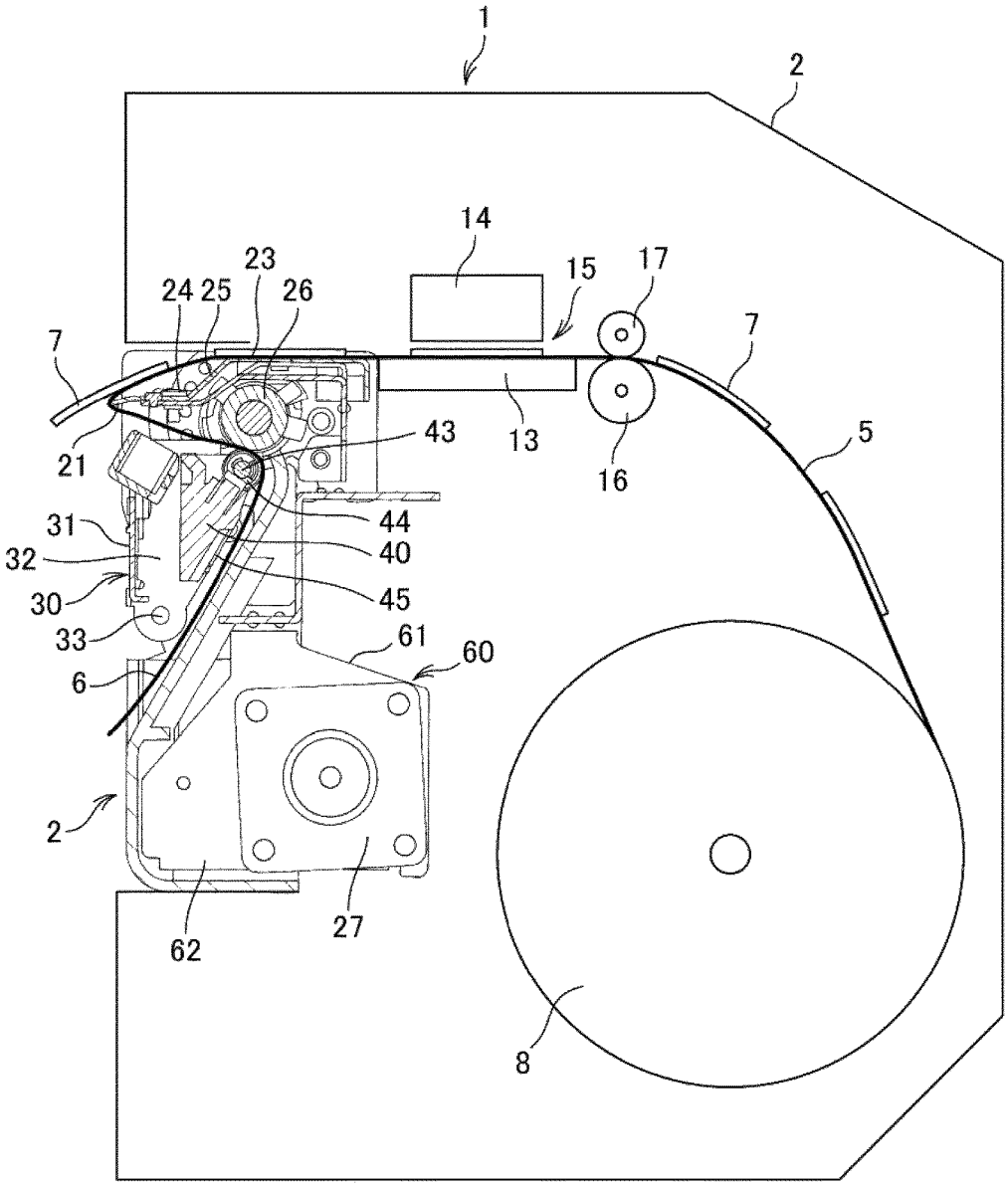
FIG. 2 is a schematic cross-sectional view of the ink jet printer.
Figure 3:
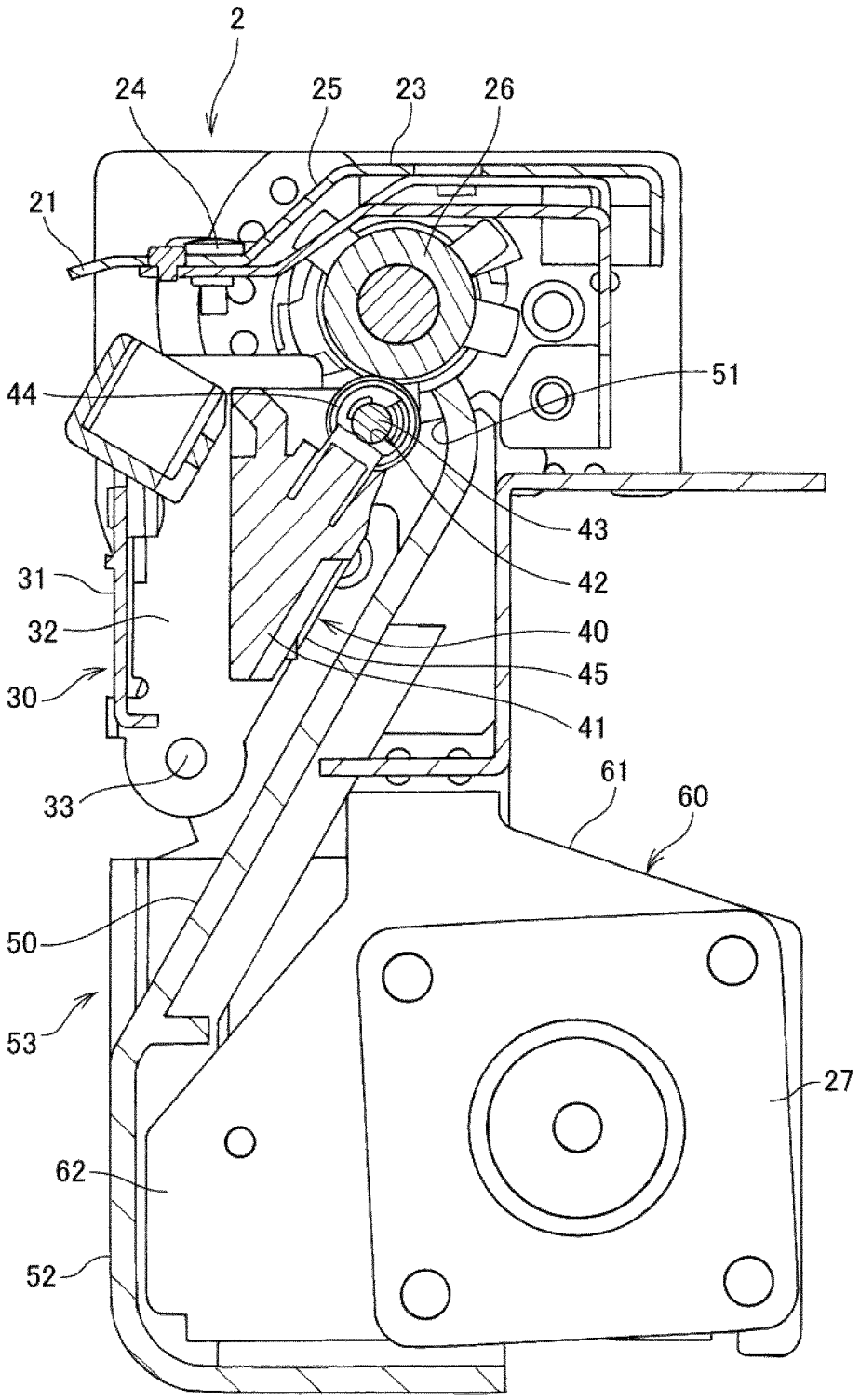
FIG. 3 is a schematic configuration diagram of a peeling device provided in the ink jet printer.
Figure 4:
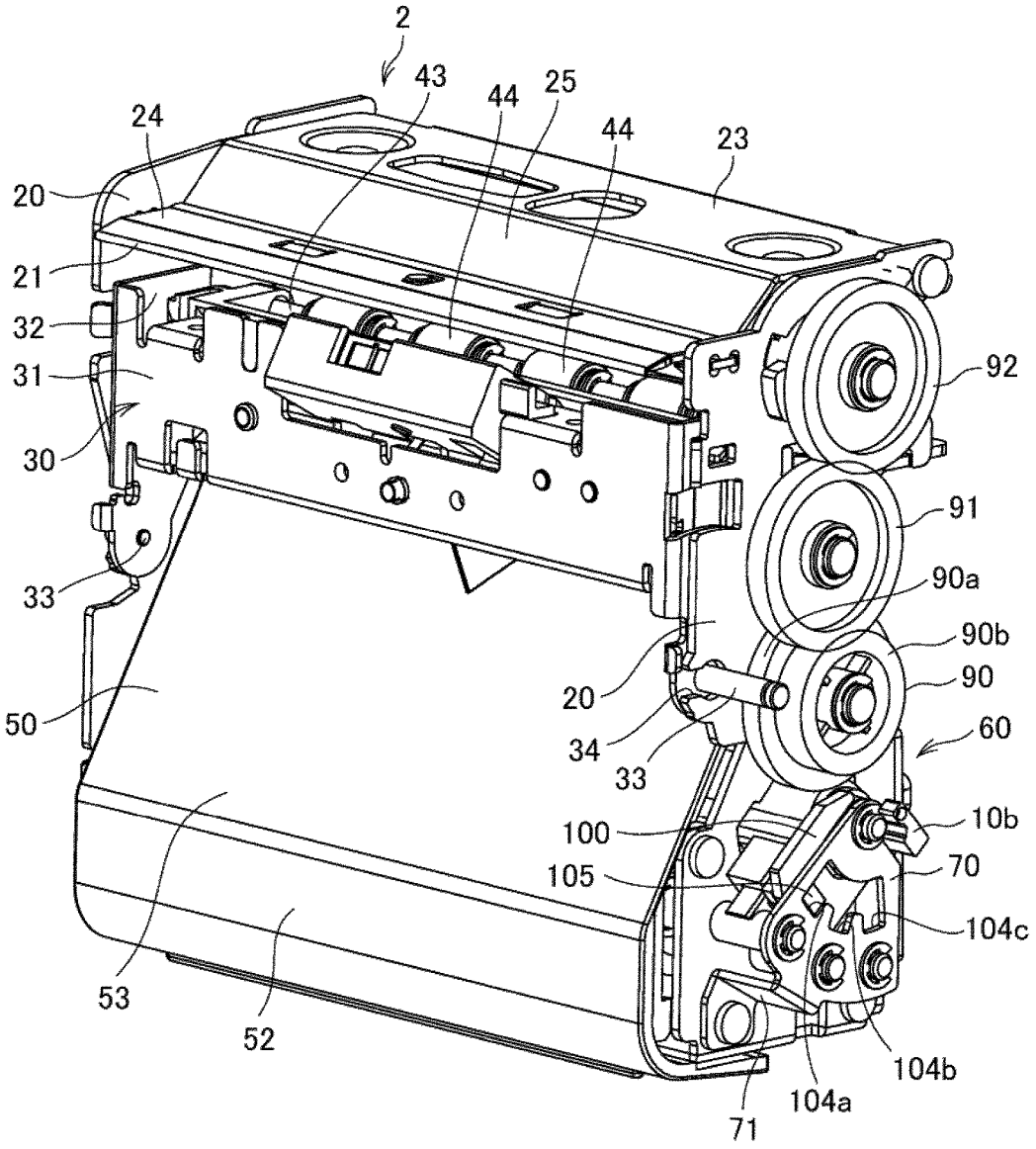
FIG. 4 is a schematic perspective view of the peeling device 2.

FIG. 1 is a schematic perspective view of a label printer 1 (an ink jet printer) according to the exemplary embodiment of the invention. FIG. 2 is a schematic cross-sectional view of the label printer 1. FIG. 3 is a schematic configuration diagram of a peeling device 2 provided in the label printer 1. FIG. 4 is a schematic perspective view of the peeling device 2.

In the present exemplary embodiment, the label printer 1 performs printing on a long label paper 5.

The label printer 1 records an image on the label paper 5 with the ink jet technology on the basis of image data received from, for example, a computer (not illustrated) communicably connected to the label printer 1.

The label paper 5 includes continuous, belt-shaped backing paper 6, and a plurality of labels 7 attached to one surface (a first surface) of the backing paper 6 at substantially equal intervals. Any material can be used for the backing paper 6 and the labels 7. In the exemplary embodiment, the label paper 5 is provided in the form of paper roll 8, but is not limited to such a form. For example, fanfold paper may be used for the label paper 5.

The label printer 1 has a body casing 10 formed in a substantially rectangular parallelepiped shape. The body casing 10 has the peeling device 2 mounted on a front side thereof in a detachable manner.

The body casing 10 has an operation unit 11 and a display unit 12 disposed on an upper front side thereof. The operation unit 11 is used by a user to operate various functions of the label printer 1. The display unit 12 displays the operation state of the label printer 1.

As illustrated in FIG. 2, the body casing 10 has a platen 13 disposed on an upper inner side thereof. Above the platen 13, a printhead 14 (inkjet head) is disposed with an ink nozzle surface thereof facing the platen 13. The position where the platen 13 and the printhead 14 are disposed is defined as a printing section 15.

The printhead 14 is mounted on a carriage (not-illustrated). The carriage is driven by a carriage driving motor (not-illustrated) to reciprocate along the guide shaft (not illustrated). The driven carriage enables the printhead 14 to reciprocate in a direction perpendicular to the paper surface of FIG. 2.

The body casing 10 houses the paper roll 8 on a lower inner side thereof. The paper roll 8 is a roll of wound label paper 5. Between the paper roll 8 and the platen 13, a printer-side transport roller 16 is disposed and is driven to rotate by a motor (not-illustrated). Above the printer-side transport roller 16, a printer-side driven roller 17 pressed against the printer-side transport roller 16 is disposed. The label paper 5 pulled out from the paper roll 8 is transported to between the platen 13 and the printhead 14 by the rotational drive of the printer-side transport roller 16 with the label paper 5 interposed between the printer-side transport roller 16 and the printer-side driven roller 17.

The following describes the peeling device 2.

As illustrated in FIG. 3 and FIG. 4, the peeling device 2 includes a pair of side frames 20 facing each other and a peeling plate 21 supported between upper end portions of the side frames 20.

The peeling plate 21 has an upper guide surface 23 at the height of the transport surface for the label paper 5 on the platen 13. Along the upper guide surface 23, the label paper 5 is transported. The label paper 5 transported along the upper guide surface 23 is bent by the peeling plate 21 toward a side of the backing paper 6 where no label 7 is attached. In the exemplary embodiment, the label paper 5 is bent downward in the vertical direction. At the peeling plate 21, the label 7 is peeled off from the backing paper 6 and discharged from a label exit (not-illustrated).

The tip of the peeling plate 21 located on the far side from the platen 13 is lower than the transport surface on the platen 13 in the vertical direction. The peeling plate 21 has a lower guide surface 24 and an oblique surface 25. The lower guide surface 24 is lower than the upper guide surface 23 in the vertical direction. The oblique surface 25 connects the upper guide surface 23 and the lower guide surface 24. The tip of the peeling plate 21 on the lower guide surface 24 located on the far side from the platen 13 is thus lower than the platen 13 in the vertical direction.

On the lower surface side of the upper guide surface 23 of the peeling plate 21, a driving roller 26 is disposed. The driving roller 26 is driven to rotate by a driving motor 27 (described later) with a given torque.

Figure 5:
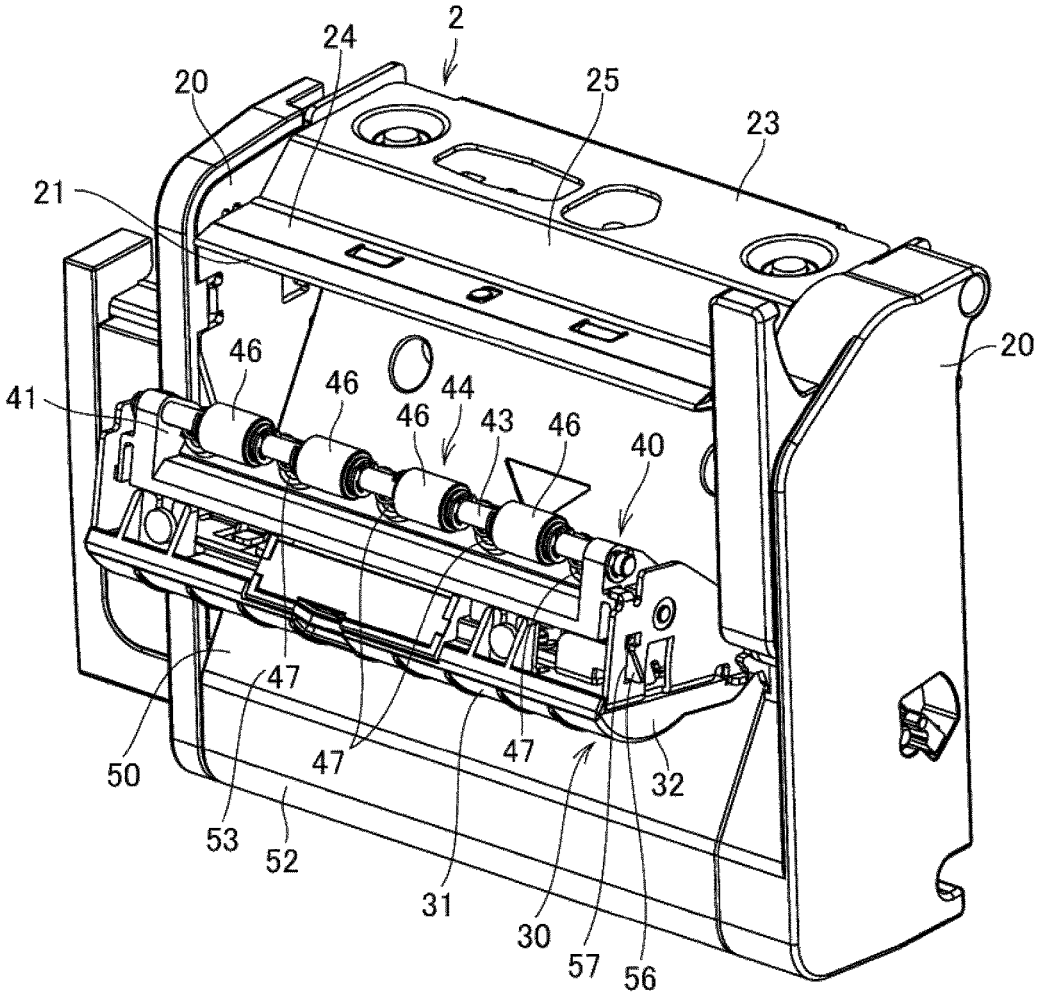
FIG. 5 is a perspective view of the peeling device with a roller support frame open.
Figure 6:
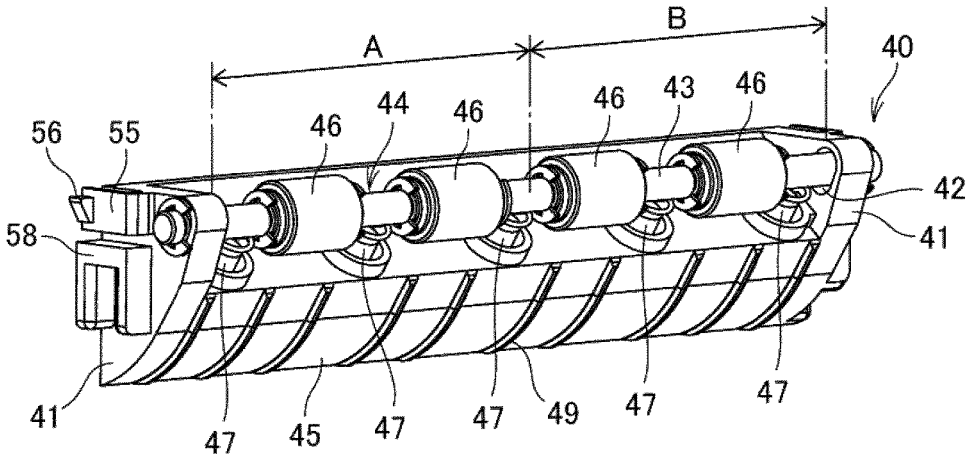
FIG. 6 is a perspective view of a pressing roller unit.

FIG. 5 is a perspective view of the peeling device 2 with a roller support frame 30 open. FIG. 6 is a perspective view of a pressing roller unit 40 (a roller unit).

On the upper front side of the side frames 20, the roller support frame 30 is provided as a cover. The roller support frame 30 includes a front plate 31 and a pair of side plates 32. A lower end portion of each of the side plates 32 of the roller support frame 30 is connected to the side frame 20 via a support shaft 33. The roller support frame 30 revolves around the support shafts 33 to open and close.

On the rear side of the roller support frame 30, that is, inside of the body casing 10, the pressing roller unit 40 is detachably mounted.

The pressing roller unit 40 includes side support frames 41 (support portions) on both sides thereof. Each of the side support frames 41 has a long support through-hole 42 formed therethrough. Between the support through-holes 42 of the side support frames 41, a roller shaft 43 (a shaft) is supported.

The roller shaft 43 has a pressing roller 44 (a first roller). The pressing roller 44 is a split roller including the roller shaft 43 and a plurality of rollers 46 through which the roller shaft 43 is inserted.

Coil springs 47 (as biasing members) are disposed on the roller shaft 43 in an area between the support frames 41. In the exemplary embodiment, the coil springs 47 are disposed between the rollers 46 of the pressing roller 44, and between the end rollers 46 and the support frames 41.

Specifically, in the exemplary embodiment, with respect to the center of the roller shaft 43 in the width direction intersecting the transport direction of the backing paper 6, an equal number of coil springs 47 are disposed individually in a first area A and a second area B, the first area A occupying one side of the center and the second area B occupying the other side of the center. Further, the coil springs 47 are disposed in symmetrical positions with respect to the center of the roller shaft 43 in the width direction intersecting the transport direction of the backing paper 6.

Therefore, in the exemplary embodiment, the equal number of coil springs 47 are disposed in the symmetrical positions on left and right sides of the center of the roller shaft 43.

The coil springs 47 are configured to bias the roller shaft 43 toward the driving roller 26. This configuration causes the pressing roller 44 to be pressed against the periphery of the driving roller 26, bringing the driving roller 26 and the pressing roller 44 into a pair of interposing rollers 48.

In this case, the pressing roller 44 comes into contact with a label attaching surface (the first surface) of the backing paper 6, and the driving roller 26 comes into contact with a surface of the backing paper 6 opposite to the label attaching surface.

Below the pressing roller 44, a guide 45 is provided extending to the lower end portion of the pressing roller unit 40. On a surface of the guide 45, that is, on a surface of the guide 45 facing a transport path of the backing paper 6, a plurality of ribs 49 are formed.

Plate spring-shaped elastic members 55 are provided on the outer surfaces of the support frames 41, for example. At tips of the elastic members 55, engaging claws 56 (operating portions) are provided. Each of the engaging claws 56 is biased outward of the support frame 41. When a force is applied from outside toward the support frame 41, the engaging claw 56 is capable of moving toward the support frame 41 against the biasing force of the elastic member 55.

On the other hand, engaging through-holes 57, with which the engaging claws 56 engage, are formed through the side plates 32 of the roller support frame 30.

On the support frames 41, guide frames 58 are formed which engage with guide protrusions (not illustrated) provided on the roller support frame 30.

When the pressing roller unit 40 is mounted on the roller support frame 30, as illustrated in FIG. 5, the guide frames 58 are inserted along the guide protrusions of the roller support frame 30 with the roller support frame 30 swung forward of the body casing 10 around the support shafts 33. When entering into the inner side of the side plates 32 of the roller support frame 30, the engaging claws 56 are moved inward by the side plates 32 against the biasing force of the elastic members 55, thereby causing the pressing roller unit 40 to be inserted between the side plates 32. Further pushing the pressing roller unit 40 causes the engaging claws 56 to engage with the engaging through-holes 57, thereby causing the pressing roller unit 40 to be held between the side plates 32.

After the pressing roller unit 40 is mounted, swinging the roller support frame 30 rearward of the body casing 10 around the support shafts 33 to close the roller support frame 30 brings the peeling device 2 into an available state, as illustrated in FIG. 4.

Further, when the pressing roller unit 40 is removed, the roller support frame 30 is swung forward of the body casing 10 around the support shafts 33. In this state, pushing the engaging claws 56 inward and pulling out the pressing roller unit 40 forward while releasing the engagement between the engaging claws 56 and the engaging holes 57 allows the pressing roller unit 40 to be removed.

In this case, in the exemplary embodiment, with the roller support frame 30 having the pressing roller unit 40 mounted thereon closed, the engaging claws 56 are not exposed to the outside of the peeling device 2, and thus the engaging claws 56 cannot be operated from the outside.

In the peeling device 2, a paper-discharge guide plate 50 is disposed facing the guide 45. The paper-discharge guide plate 50 is oblique so that an upper end thereof is positioned on the rear side of the peeling device 2 and a lower end thereof is positioned on the front side.

At the upper end of the paper-discharge guide plate 50, a curved surface 51 is provided. The curved surface 51 guides downward the backing paper 6 of the label paper 5 transported while being interposed between the driving roller 26 and the pressing roller 44. At the lower end of the paper-discharge guide plate 50, a cover 52 is provided. The cover 52 continuously covers the lower front surface and the bottom surface of the peeling device 2. The lower end portion of the paper-discharge guide plate 50 is a backing-paper exit 53 that discharges the backing paper 6 of the label paper 5 to the outside.

The backing paper 6 of the label paper 5 is transported while being interposed between the driving roller 26 and the pressing roller 44, and guided downward by the curved surface 51. The backing paper 6 of the label paper 5 passes through between the guide 45 and the paper-discharge guide plate 50 and is then discharged from the backing-paper exit 53 to the outside.

Further, as illustrated in FIG. 3 and FIG. 4, the peeling device 2 includes a driving unit 60.

The driving unit 60 includes a casing 61. The casing 61 includes a pair of side plates 62 facing each other.

In the exemplary embodiment, the driving motor 27 is installed on the outer side of one of the side plates 62. A stepping motor is used as the driving motor 27, for example.

On the outer side of the other side plate 62, an substantially triangle-shaped stopper member 70 is disposed.

In the casing 61, three torque limiters (not illustrated) and an output gear 87 are provided. The torque limiters are driven to rotate by the rotation of the driving motor 27. The output gear 87 is selectively meshed with each of the torque limiters.

Further, an operating lever 100 is swingably disposed between the stopper member 70 and the side plate 62. The operating lever 100 is used by the user to switch the torque limiters.

The stopper member 70 has an engaging opening 102 formed therethrough. On the lower side of the engaging opening 102, two protrusions 103 are formed and three engaging grooves 104 defined by the protrusions 103 are formed.

The operating lever 100 has an engaging protrusion 105 formed on the tip side thereof. The engaging protrusion 105 engages with the engaging grooves 104. The operating lever 100 has an operating protrusion 106 formed at the base end thereof.

Then, operating the operating protrusion 106 of the operating lever 100 to engage the engaging protrusion 105 of the operating lever 100 with a specific one of the engaging grooves 104 allows the torque limiters to be switched.

In this configuration, for example, the torque required to transport the label paper 5 varies depending on the paper type of the backing paper 6 of the label paper 5 such as the paper quality, paper thickness, and paper width, allowing the label paper 5 to be transported with an appropriate torque in accordance with the paper type of the label paper 5.

Further, a double gear 90 is provided on the outer side of the side plate 62. A large-diameter gear 90*a* of the double gear 90 meshes with the output gear 87 at the position protruding from the side plate 62. A small-diameter gear 90*b* of the double gear 90 meshes with a transport gear 92 coupled coaxially to the driving roller 26 through a transmission gear 91.

In this configuration, the driving roller 26 driven by the driving motor 27 is driven to rotate at a rotational speed slightly higher than that of the printer-side transport roller 16.

Such a drive operation causes the transport amount during printing to be regulated by the printer-side transport roller 16, allowing the driving roller 26 to constantly apply specific tension to the backing paper 6 of the label paper 5. The application of the specific tension to the backing paper 6 prevents the backing paper 6 from loosening during transport and allows the backing paper 6 passing over the tip portion of the peeling plate 21 to be transported at an acute angle along the peeling plate 21. As a result, the labels 7 can be peeled off smoothly, and floating of the label paper 5 can be prevented.

The following describes the advantageous effects of the exemplary embodiment.

Firstly, with the peeling device 2 removed from the label printer 1, the operating protrusion 106 is operated in accordance with the paper type such as the thickness and width of the backing paper 6 of the paper roll 8 used, causing the engaging protrusion 105 of the operating lever 100 to engage with any one of the engaging grooves 104.

Then, upon receiving image data from the computer (not illustrated), communicably connected to the label printer 1, the label printer 1 drives the motor (not illustrated) to rotate the printer-side transport roller 16 while driving the driving motor 27 to rotate the driving roller 26.

As a result, the label paper 5 pulled out from the paper roll 8 is interposed between the printer-side transport roller 16 and the printer-side driven roller 17, and then transported to between the platen 13 and the printhead 14.

Then, the printhead 14 is operated in accordance with the image data to perform printing on the labels 7 of the label paper 5 transported onto the platen 13.

After the printing is completed, the label paper 5 is transported along the upper guide surface 23 of the peeling plate 21. The backing paper 6 of the label paper 5 is transported while being interposed between the driving roller 26 and the pressing roller 44, and thus, only the backing paper 6 is transported while being bent at an acute angle by the peeling plate 21. This operation peels off only the labels 7 from the backing paper 6 of the label paper 5 and discharges the labels 7 from the peeling device 2.

On the other hand, the backing paper 6 from which the labels 7 have been peeled off is transported while being interposed between the driving roller 26 and the pressing roller 44, and guided downward by the curved surface 51. The backing paper 6 passes through between the guide 45 and the paper-discharge guide plate 50 and is then discharged from the backing-paper exit 53 to the outside.

Here, after the labels 7 have been peeled off, adhesive may remain on the backing paper 6. The surface (the first surface) of the backing paper 6 on which the adhesive remains comes into contact with the pressing roller 44. However, in the exemplary embodiment, the biasing force can be applied evenly to the roller shaft 43 by the coil springs 47, allowing the backing paper 6 to be stably transported.

Further, the guide 45 is provided in the pressing roller unit 40. Thus, even when the adhesive is adhered to the pressing roller 44 and the surface of the pressing roller 44 and the backing paper 6 adhere to each other, the guide 45 can prevent entanglement of the backing paper 6.

Further, the ribs 49 formed on the guide 45 allows a contact area between the backing paper 6 on which the adhesive remains and the guide 45 to be reduced, making it possible to prevent the backing paper 6 from adhering to the guide 45.

Further, in the exemplary embodiment, the pressing roller unit 40 is detachable, allowing the pressing roller unit 40 to be easily replaced as a whole when the adhesive is adhered to, for example, the surface of the pressing roller 44 or the guide 45. This configuration eliminates the need for maintenance, such as cleaning and replacement, of the pressing roller 44 and the guide 45, allowing usability to be improved.

As described above, according to the exemplary embodiment of the invention, the peeling device 2 has the pressing roller 44 (a first roller) and the driving roller 26 (a second roller). The pressing roller 44 comes into contact with the attaching surface (the first surface) of the backing paper 6 to which the labels 7 are attached, and the driving roller 26 comes into contact with the back surface of the backing paper 6. The peeling device 2 includes the peeling plate 21. The peeling plate 21 is located on the upstream side of the interposing roller pair 48 in the transport direction of the backing paper 6 when the labels 7 are peeled off from the backing paper 6, and bends the transport path of the backing paper 6. The pressing roller 44 is the split roller including the roller shaft 43 (a shaft) and the plurality of rollers 46. The peeling device 2 includes the support frames 41 (support portions) and the coil springs 47 (biasing members). The support frames 41 support the pressing roller 44. The coil springs 47 come into contact with the roller shaft 43 in the area between the support frames 41 and bias the pressing roller 44 toward the driving roller 26.

In this configuration, the coil springs 47 are provided that come into contact with the roller shaft 43 in the area between the support frames 41 and that bias the pressing roller 44 toward the driving roller 26, allowing the coil springs 47 to evenly apply the biasing force to the roller shaft 43.

As a result, each of the rollers 46 of the pressing roller 44 can be pressed evenly against the driving roller 26, allowing the transport accuracy of the backing paper 6 to be improved. According to this configuration, even in the printing section 15 defined by the printhead 14 and the platen 13, the transport accuracy of the label paper 5 can be improved, and the printing quality can be also improved.

Further, according to the exemplary embodiment, with respect to the center in the width direction intersecting the transport direction of the backing paper 6, the equal number of coil springs 47 are disposed in the first area A and second area B on the pressing roller 44, the first area A occupying the one side of the center and the second area B occupying the other side of the center.

This configuration allows the equal number of coil springs 47 to be individually disposed on the left and right sides with respect to the center, allowing the coil springs 47 to evenly apply the biasing force to the roller shaft 43.

Further, according to the exemplary embodiment, the coil springs 47 are disposed in the symmetrical positions on the pressing roller 44 with respect to the center in the width direction intersecting the transport direction of the backing paper 6.

This configuration allows the coil springs 47 to be disposed in the symmetrical positions on the left and right sides with respect to the center, allowing the coil springs 47 to evenly apply the biasing force to the roller shaft 43.

Further, according to the exemplary embodiment, the peeling device 2 includes the pressing roller unit 40 (a roller unit) that has the pressing roller 44 and the coil springs 47 mounted thereon.

According to this configuration, the pressing roller unit 40 is detachable, allowing the pressing roller unit 40 to be easily replaced as a whole when the adhesive is adhered to, for example, the surface of the pressing roller 44. This configuration eliminates the need for maintenance, such as cleaning and replacement, of the pressing roller 44, allowing usability to be improved.

Further, according to the exemplary embodiment, the pressing roller unit 40 is detachably provided in the roller support frame 30 (a cover) that revolves, and the engaging claws 56 (an operating portion) of the pressing roller unit 40 are disposed in the positions where the engaging claws 56 cannot be operated with the roller support frame 30 closed.

According to this configuration, the engaging claws 56 are disposed in the positions where the engaging claws 56 cannot be operated with the roller support frame 30 closed, preventing the user from accidentally removing the pressing roller unit 40 while the peeling device 2 is in operation.

Further, according to the exemplary embodiment, the pressing roller unit 40 has the ribs 49 on the surface facing the transport path of the backing paper 6.

This configuration in which the ribs 49 are formed can reduce the contact area between the backing paper 6 on which the adhesive remains and the transport path, preventing the backing paper 6 from adhering to the transport path.

While the exemplary embodiment according to the invention has been described, the invention is not limited to such an exemplary embodiment and may be variously modified as necessary.

This application claims priority under 35 U.S.C. § 119 to Japanese Patent Application No. 2016-129814, filed Jun. 30, 2016. The entire disclosure of Japanese Patent Application No. 2016-129814 is hereby incorporated herein by reference.

What is claimed is:

1. A peeling device configured to peel off a label attached to a first surface of backing paper, the peeling device comprising:

an interposing roller pair including a first roller and a second roller, the first roller being configured to come into contact with the first surface, the second roller being configured to come into contact with a surface of the backing paper different from the first surface, the interposing roller pair being configured to interpose and transport the backing paper;

a peeling plate provided on an upstream side of the interposing roller pair in a transport direction of the backing paper when the label is peeled off from the backing paper, the peeling plate being configured to bend a transport path of the backing paper, the first roller being a split roller including a shaft and a plurality of rollers through which the shaft is inserted;

support portions configured to support the first roller; and a biasing member configured to come into contact with the shaft in an area on the first roller between the support portions, the biasing member being configured to bias the first roller toward the second roller.

2. The peeling device according to claim 1, wherein, with respect to a center in a width direction intersecting the transport direction of the backing paper, an equal number of the biasing members are disposed individually in a first and second areas on the first roller, the first area occupying one side of the center and the second area occupying an other side of the center.

3. The peeling device according to claim 1, wherein with respect to a center in a width direction intersecting the transport direction of the backing paper, the biasing members are disposed in symmetrical positions on the first roller.

4. The peeling device according to claim 1, further comprising a roller unit having the first roller and the biasing members mounted thereon.

5. The peeling device according to claim 4, further comprising an operating portion operated by a user, wherein:

the roller unit is;

detachably provided in a cover configured to revolve, and attached and detached according to operation to the operating portion, and the operating portion is inoperable with the cover closed.

6. The peeling device according to claim 5, wherein the roller unit has a rib on a surface thereof facing the transport path of the backing paper.

7. The peeling device according to claim 5, wherein, with respect to a center in a width direction intersecting the transport direction of the backing paper, an equal number of the biasing members are disposed individually in a first and second areas on the first roller, the first area occupying one side of the center and the second area occupying an other side of the center.

8. The peeling device according to claim 5, wherein with respect to a center in a width direction intersecting the transport direction of the backing paper, the biasing members are disposed in symmetrical positions on the first roller.

9. An ink jet printer comprising:

a printhead configured to print on label paper including backing paper and a label attached to a first surface of the backing paper;

an interposing roller pair including a first roller and a second roller, the first roller being configured to come into contact with the first surface, the second roller being configured to come into contact with a surface of the backing paper different from the first surface, the interposing roller pair being configured to interpose and transport the backing paper;

a peeling plate provided on an upstream side of the interposing roller pair in a transport direction of the backing paper when the label is peeled off from the backing paper, the peeling plate being configured to bend a transport path of the backing paper, the first roller being a split roller including a shaft and a plurality of rollers through which the shaft is inserted;

support portions configured to support the first roller; and a biasing member configured to come into contact with the shaft in an area on the first roller between the support portions, the biasing member being configured to bias the first roller toward the second roller.

10. The ink jet printer according to claim 9, wherein, with respect to a center in a width direction intersecting the transport direction of the backing paper, an equal number of the biasing members are disposed individually in a first and second areas on the first roller, the first area occupying one side of the center and the second area occupying an other side of the center.

11. The ink jet printer according to claim 9, wherein with respect to a center in a width direction intersecting the transport direction of the backing paper, the biasing members are disposed in symmetrical positions on the first roller.

12. The ink jet printer according to claim 9, further comprising a roller unit having the first roller and the biasing members mounted thereon.

13. The ink jet printer according to claim 12, further comprising an operating portion operated by a user, wherein:

the roller unit is;

detachably provided in a cover configured to revolve, and attached and detached according to operation to the operating portion, and the operating portion is inoperable with the cover closed.

14. The ink jet printer according to claim 13, wherein, with respect to a center in a width direction intersecting the transport direction of the backing paper, an equal number of the biasing members are disposed individually in a first and second areas on the first roller, the first area occupying one side of the center and the second area occupying an other side of the center.

15. The ink jet printer according to claim 13, wherein with respect to a center in a width direction intersecting the transport direction of the backing paper, the biasing members are disposed in symmetrical positions on the first roller.

16. The ink jet printer according to claim 13, wherein the roller unit has a rib on a surface thereof facing the transport path of the backing paper.

17. The ink jet printer according to claim 12, wherein the roller unit has a rib on a surface thereof facing the transport path of the backing paper.

* * * * *